US010714016B2

(12) United States Patent
Liu

(10) Patent No.: US 10,714,016 B2
(45) Date of Patent: Jul. 14, 2020

(54) GOA CIRCUIT AND OLED DISPLAY DEVICE

(71) Applicant: Wuhan China Star Optoelectronics Semiconductor Display Technology Co., Ltd., Wuhan, Hubei (CN)

(72) Inventor: Jie Liu, Hubei (CN)

(73) Assignee: WUHAN CHINA STAR OPTOELECTRONICS SEMICONDUCTOR DISPLAY TECHNOLOGY CO., LTD., Wuhan, Hubei (CN)

( * ) Notice: Subject to any disclaimer, the term of this patent is extended or adjusted under 35 U.S.C. 154(b) by 247 days.

(21) Appl. No.: 15/767,816

(22) PCT Filed: Feb. 26, 2018

(86) PCT No.: PCT/CN2018/077275

§ 371 (c)(1),
(2) Date: Apr. 12, 2018

(87) PCT Pub. No.: WO2019/148561

PCT Pub. Date: Aug. 8, 2019

(65) Prior Publication Data

US 2019/0378461 A1 Dec. 12, 2019

(30) Foreign Application Priority Data

Feb. 1, 2018 (CN) ..... 2018 1 0103749

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0408* (2013.01); *G09G 2310/08* (2013.01); *G09G 2380/02* (2013.01)

(58) Field of Classification Search
None
See application file for complete search history.

(56) References Cited

U.S. PATENT DOCUMENTS

2015/0269897 A1* 9/2015 Kitsomboonloha ..... G09G 3/3648 345/205
2016/0086562 A1* 3/2016 Tan ..... G09G 3/3677 345/215

(Continued)

FOREIGN PATENT DOCUMENTS

CN 106652918 A 5/2017

*Primary Examiner* — Amare Mengistu
*Assistant Examiner* — Sarvesh J Nadkarni
(74) *Attorney, Agent, or Firm* — Leong C. Lei

(57) ABSTRACT

The invention provides a GOA circuit and OLED display device. The GOA circuit comprises a plurality of cascaded GOA units, with each GOA unit comprising: a scan signal output module and an emitting signal output module electrically connected to the scan signal output module; during a frame period, the scan signal output module is capable of outputting a scanning signal including at least two low potential pulses within a frame time, and the light emitting signal output module can output a valid emitting signal according to the scan signal outputted by the scan signal output module. Thus, the GOA circuit for scan signal and the GOA circuit for emitting signal in the conventional design are integrated into a GOA circuit, which can reduce the number of TFTs and capacitors, simplify the circuit structure, and facilitate narrow-border display.

11 Claims, 3 Drawing Sheets

(56) References Cited

U.S. PATENT DOCUMENTS

| | | | | |
|---|---|---|---|---|
| 2017/0004775 | A1* | 1/2017 | Chen | G09G 3/3266 |
| 2017/0032752 | A1* | 2/2017 | Huang | G09G 3/3648 |
| 2017/0116924 | A1* | 4/2017 | Zhang | G09G 3/3233 |
| 2018/0218685 | A1* | 8/2018 | Li | G09G 3/3258 |

* cited by examiner

GOA CIRCUIT AND OLED DISPLAY DEVICE

RELATED APPLICATIONS

The present application is a National Phase of International Application Number PCT/CN2018/077275, filed Feb. 26, 2018, and claims the priority of China Application No. 201810103749.7, filed Feb. 1, 2018.

BACKGROUND OF THE INVENTION

1. Field of the Invention

The present invention relates to the field of display techniques, and in particular to a gate driver on array (GOA) circuit and an light-emitting diode (OLED) display device.

2. The Related Arts

The organic light-emitting diode (OLED) display device provides the advantages of self-luminous, low driving voltage, high luminous efficiency, short response time, sharpness and contrast, nearly 180° viewing angle, wide temperature range, flexibility, ability to achieve flexible display and large-area full-color display, and many other advantages, and is recognized by the industry as the most promising display device.

The OLED display device generally comprises a substrate, an anode disposed on the substrate, a hole injection layer (HIL) disposed on the anode, a hole transport layer (HTL) disposed on the hole injection layer, a light-emitting layer disposed on the hole transport layer, an electron transport layer (ETL) on the light-emitting layer, an electron injection layer (EIL) disposed on the electron transport layer, and a cathode disposed on the electron injection layer. The light-emitting principle of OLED display devices is as follows: the semiconductor material and organic light-emitting material are driven by the electric field driven to cause light emission through carrier injection and recombination. Specifically, the OLED display device usually adopts an indium tin oxide (ITO) pixel electrode and a metal electrode as an anode and a cathode, respectively. Under a certain voltage, electrons and holes are injected from the cathode and the anode into the electron transport layer and the hole transport layers respectively, the electrons and holes respectively migrate through the electron transport layer and the hole transport layer to the light-emitting layer and meet in the light-emitting layer to form excitons and excite the light-emitting molecules that emit visible light through radiation relaxation.

The gate driver on array (GOA) technology, i.e., the array substrate row driving technology, can use the array process of the LCD panel to manufacture the driver circuit of the horizontal scan lines on the substrate at area surrounding the active area to replace the external IC for driving the horizontal scan lines. The GOA technology can reduce the bonding process for external IC and has the opportunity to enhance yield rate and reduce production cost, as well as make the LCD panel more suitable for the production of narrow border display products.

For the OLED display device, a driving thin film transistor (TFT) for driving the OLED is provided in the pixel driving circuit. During the use, due to the aging of the OLED and the threshold voltage drift of the driving TFT, the display quality of the OLED display device is degraded. Therefore, the threshold voltage of the driving TFT needs to be compensated during the use of the OLED display device.

In order to control the OLED device driving circuit, in addition to the general scan (SCAN) signal to a scan line, more control signals, such as, emitting (EM) signal, are needed. In the traditional mode, the EM GOA circuit and the SCAN GOA circuit are respectively disposed to generate the EM signal and the SCAN signal, resulting in the complex circuit, large number of thin film transistors and capacitors, which is not conducive to the realization of narrow borders.

SUMMARY OF THE INVENTION

The object of the present invention is to provide a GOA circuit, able to output SCAN signal and EM signal, with simple circuit structure, and able to facilitate production cost reduction and achieving narrow border design.

Another object of the present invention is to provide an OLED display device, having a GOA circuit able to output SCAN signal and EM signal, with simple circuit structure, and able to facilitate production cost reduction and achieving narrow border design.

To achieve the above object, the present invention provides a GOA circuit, which comprises a plurality of cascaded GOA units, with each GOA unit comprising: a scan signal output module and an emitting signal output module electrically connected to the scan signal output module;

for a positive integer n, except the first GOA unit, in the n-th GOA unit:

the scan signal output module, receiving an m-th clock signal, an (m+1)-th clock signal, and a scan signal of the (n−1)-th GOA unit, for outputting a scan signal of n-th GOA unit to sub-pixels of n-th row and the emitting signal output module of the n-th GOA unit according to the m-th clock signal under the control of the scan signal of the (n−1)-th GOA unit;

the emitting signal output module, receiving the scan signal outputted by the scan signal output module of the n-th GOA unit, for outputting an emitting signal of the n-th GOA unit to the sub-pixels of n-th row;

during a frame period, the scan signal of each GOA unit comprising at least two low voltage pulses, the emitting signal of each GOA unit having a duration of outputting high voltage longer than twice the pulse cycle of the m-th clock signal, and the m-th clock signal and the (m+1)-th clock signal having opposite phases.

According to a preferred embodiment of the present invention, the scan signal output module comprises: a first thin film transistor (TFT), a second TFT, a third TFT, a fourth TFT, a fifth TFT, a sixth TFT, a seventh TFT, an eighth TFT, a ninth TFT, a tenth TFT, an eleventh TFT, a twelfth TFT, a first capacitor, a second capacitor, a third capacitor, and a fourth capacitor;

the first TFT having a gate receiving a constant low voltage, a source electrically connected to a drain of the second TFT, and a drain electrically connected to a first node of the n-th GOA unit;

the second TFT having a gate and a source, both receiving the scan signal of the (n−1)-th GOA unit;

the third TFT having a gate receiving the constant low voltage, a source electrically connected to the source of the second TFT, and a drain electrically connected to a gate of the fifth TFT;

the fourth TFT having a gate receiving the constant low voltage, a source electrically connected to the first node of the n-th GOA unit, and a drain electrically connected to a source of the sixth TFT;

the fifth TFT having a source electrically connected to a second node of the n-th GOA unit, and a drain receiving a constant high voltage;

the sixth TFT having a gate electrically connected to the second node of the n-th GOA unit, and a drain receiving a constant high voltage;

the seventh TFT having a gate electrically connected to the drain of the third TFT, a source electrically connected to a drain of the eighth TFT, and a drain receiving the constant high voltage;

the eighth TFT having a gate and a source, both receiving the m-th clock signal;

the ninth TFT having a gate receiving the (m+1)-th clock signal, a source electrically connected to a drain of the tenth TFT, and a drain electrically connected to the second node of the n-th GOA unit;

the tenth TFT having a gate electrically connected to the drain of the eighth TFT, and a source receiving the (m+1)-th clock signal;

the eleventh TFT having a gate electrically connected to the second node of the GOA unit, a source electrically connected to a drain of the twelfth TFT, and a drain receiving the constant high voltage;

the twelfth TFT having a gate electrically connected to the first node of the GOA unit, a source receiving the m-th clock signal, and a drain outputting the scan signal of the n-th GOA unit;

the first capacitor having a first end electrically connected to the source of the sixth TFT, and a second end receiving the constant high voltage;

the second capacitor having a first end electrically connected to the first node of the GOA unit, and a second end electrically connected to the drain of the twelfth TFT;

the third capacitor having a first end electrically connected to the second node of the GOA unit, and a second end receiving the constant high voltage;

the fourth capacitor having a first end electrically connected to the drain of the eighth TFT, and a second end receiving the constant high voltage.

According to a preferred embodiment of the present invention, the emitting signal output module comprises: a thirteenth TFT, a fourteenth TFT, a fifteenth TFT, a sixteenth TFT, and a fifth capacitor;

the thirteenth TFT having a gate receiving the scan signal of the n-th GOA unit, a source receiving the constant high voltage, and a drain electrically connected to a source of the fourteenth TFT;

the fourteenth TFT having a gate receiving the emitting signal of the n-th GOA unit, and a drain receiving the constant low voltage;

the fifteenth TFT having a gate receiving the emitting signal of the n-th GOA unit, a source receiving the constant high voltage, and a drain outputting the emitting signal of the n-th GOA unit;

the sixteenth TFT having a gate electrically connected to the drain of the thirteen TFT, a source electrically connected to the drain of the fifteenth TFT, and a drain receiving the constant low voltage;

the fifth capacitor having a first end electrically connected to the drain of the thirteenth TFT, and a second end receiving the m-th clock signal.

According to a preferred embodiment of the present invention, the GOA circuit comprises two clock signals; a first clock signal and a second clock signal; when the m-th clock signal is the second clock signal, the (m+1)-th clock signal is the first clock signal.

According to a preferred embodiment of the present invention, in the first GOA unit, both the gate and the source of the second TFT receive a circuit start signal.

According to a preferred embodiment of the present invention, the first TFT, the second TFT, the third TFT, the fourth TFT, the fifth TFT, the sixth TFT, the seventh TFT, the eighth TFT, the ninth TFT, the tenth TFT, the eleventh TFT, and the twelfth TFT are all P-type TFTs.

According to a preferred embodiment of the present invention, the thirteenth TFT, the fourteenth TFT, the fifteenth TFT, and the sixteenth TFT are all P-type TFTs.

The present invention further provides an OLED display device, which comprises the aforementioned GOA circuit.

According to a preferred embodiment of the present invention, the OLED display device is a flexible OLED display device.

The present invention also provides a GOA circuit, which comprises a plurality of cascaded GOA units, with each GOA unit comprising: a scan signal output module and an emitting signal output module electrically connected to the scan signal output module;

for a positive integer n, except the first GOA unit, in the n-th GOA unit:

the scan signal output module, receiving an m-th clock signal, an (m+1)-th clock signal, and a scan signal of the (n−1)-th GOA unit, for outputting a scan signal of n-th GOA unit to sub-pixels of n-th row and the emitting signal output module of the n-th GOA unit according to the m-th clock signal under the control of the scan signal of the (n−1)-th GOA unit;

the emitting signal output module, receiving the scan signal outputted by the scan signal output module of the n-th GOA unit, for outputting an emitting signal of the n-th GOA unit to the sub-pixels of n-th row;

during a frame period, the scan signal of each GOA unit comprising at least two low voltage pulses, the emitting signal of each GOA unit having a duration of outputting high voltage longer than twice the pulse cycle of the m-th clock signal, and the m-th clock signal and the (m+1)-th clock signal having opposite phases.

wherein the scan signal output module comprising: a first thin film transistor (TFT), a second TFT, a third TFT, a fourth TFT, a fifth TFT, a sixth TFT, a seventh TFT, an eighth TFT, a ninth TFT, a tenth TFT, an eleventh TFT, a twelfth TFT, a first capacitor, a second capacitor, a third capacitor, and a fourth capacitor;

the first TFT having a gate receiving a constant low voltage, a source electrically connected to a drain of the second TFT, and a drain electrically connected to a first node of the n-th GOA unit;

the second TFT having a gate and a source, both receiving the scan signal of the (n−1)-th GOA unit;

the third TFT having a gate receiving the constant low voltage, a source electrically connected to the source of the second TFT, and a drain electrically connected to a gate of the fifth TFT;

the fourth TFT having a gate receiving the constant low voltage, a source electrically connected to the first node of the n-th GOA unit, and a drain electrically connected to a source of the sixth TFT;

the fifth TFT having a source electrically connected to a second node of the n-th GOA unit, and a drain receiving a constant high voltage;

the sixth TFT having a gate electrically connected to the second node of the n-th GOA unit, and a drain receiving a constant high voltage;

the seventh TFT having a gate electrically connected to the drain of the third TFT, a source electrically connected to a drain of the eighth TFT, and a drain receiving the constant high voltage;

the eighth TFT having a gate and a source, both receiving the m-th clock signal;

the ninth TFT having a gate receiving the (m+1)-th clock signal, a source electrically connected to a drain of the tenth TFT, and a drain electrically connected to the second node of the n-th GOA unit;

the tenth TFT having a gate electrically connected to the drain of the eighth TFT, and a source receiving the (m+1)-th clock signal;

the eleventh TFT having a gate electrically connected to the second node of the GOA unit, a source electrically connected to a drain of the twelfth TFT, and a drain receiving the constant high voltage;

the twelfth TFT having a gate electrically connected to the first node of the GOA unit, a source receiving the m-th clock signal, and a drain outputting the scan signal of the n-th GOA unit;

the first capacitor having a first end electrically connected to the source of the sixth TFT, and a second end receiving the constant high voltage;

the second capacitor having a first end electrically connected to the first node of the GOA unit, and a second end electrically connected to the drain of the twelfth TFT;

the third capacitor having a first end electrically connected to the second node of the GOA unit, and a second end receiving the constant high voltage;

the fourth capacitor having a first end electrically connected to the drain of the eighth TFT, and a second end receiving the constant high voltage;

wherein the emitting signal output module comprising: a thirteenth TFT, a fourteenth TFT, a fifteenth TFT, a sixteenth TFT, and a fifth capacitor;

the thirteenth TFT having a gate receiving the scan signal of the n-th GOA unit, a source receiving the constant high voltage, and a drain electrically connected to a source of the fourteenth TFT;

the fourteenth TFT having a gate receiving the emitting signal of the n-th GOA unit, and a drain receiving the constant low voltage;

the fifteenth TFT having a gate receiving the emitting signal of the n-th GOA unit, a source receiving the constant high voltage, and a drain outputting the emitting signal of the n-th GOA unit;

the sixteenth TFT having a gate electrically connected to the drain of the thirteen TFT, a source electrically connected to the drain of the fifteenth TFT, and a drain receiving the constant low voltage;

the fifth capacitor having a first end electrically connected to the drain of the thirteenth TFT, and a second end receiving the m-th clock signal;

comprising two clock signals; a first clock signal and a second clock signal; when the m-th clock signal being the second clock signal, the (m+1)-th clock signal being the first clock signal;

wherein in the first GOA unit, both the gate and the source of the second TFT receiving a circuit start signal.

The present invention provides the following advantages. The present invention provides a GOA circuit, comprising: a plurality of cascaded GOA units, each GOA unit comprising a scan signal output module and an emitting signal output module electrically connected to the scan signal output module; during a frame period, the scan signal output module is capable of outputting a scanning signal including at least two low potential pulses within a frame time, and the light emitting signal output module can output a valid emitting signal according to the scan signal outputted by the scan signal output module. Thus, the GOA circuit for scan signal and the GOA circuit for emitting signal in the conventional design are integrated into a GOA circuit, which can reduce the number of TFTs and capacitors, simplify the circuit structure, and facilitate narrow-border display. The present invention also provides an OLED display device, with a GOA circuit capable of outputting a scan signal and an emitting signal at the same time, and the circuit structure is simple and is conducive to the realization of a narrow-border display.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
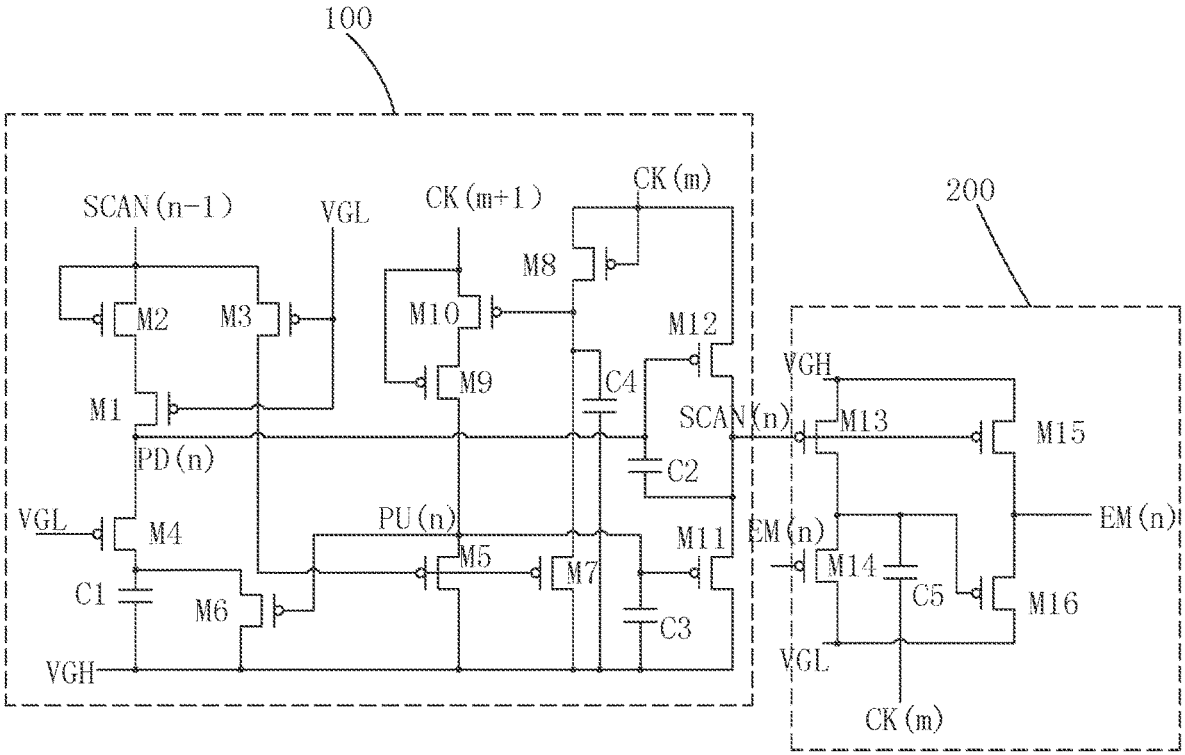
FIG. 1 is a schematic view showing an n-th GOA unit of the GOA circuit provided by the embodiment of the present invention.

Referring to FIG. 1, the present invention provides a GOA circuit, which comprises: a plurality of cascaded GOA units, with each GOA unit comprising: a scan signal output module 100 and an emitting signal output module 200 electrically connected to the scan signal output module 100.

For a positive integer n, except the first GOA unit, in the n-th GOA unit:

The scan signal output module 100, receiving an m-th clock signal CK(m), an (m+1)-th clock signal CK(m+1), and a scan signal SCAN(n−1) of the (n−1)-th GOA unit, is for outputting a scan signal SCAN(n) of n-th GOA unit to sub-pixels of n-th row and the emitting signal output module 200 of the n-th GOA unit according to the m-th clock signal CK(m) under the control of the scan signal of the (n−1)-th GOA unit SCAN(n−1);

the emitting signal output module 200, receiving the scan signal SCAN(n) outputted by the scan signal output module 100 of the n-th GOA unit, is for outputting an emitting signal EM(n) of the n-th GOA unit to the sub-pixels of n-th row.

During a frame period, the scan signal of each GOA unit comprises at least two low voltage pulses, the emitting signal of each GOA unit has a duration of outputting high voltage longer than twice the pulse cycle of the m-th clock signal CK(m), and the m-th clock signal CK(m) and the (m+1)-th clock signal CK(m+1) have opposite phases.

Specifically, the scan signal output module 100 comprises: a first thin film transistor (TFT) M1, a second TFT M2, a third TFT M3, a fourth TFT M4, a fifth TFT M5, a sixth TFT M6, a seventh TFT M7, an eighth TFT M8, a ninth TFT M9, a tenth TFT M10, an eleventh TFT M11, a twelfth TFT M12, a first capacitor C1, a second capacitor C2, a third capacitor C3, and a fourth capacitor C4.

Wherein the first TFT M1 has a gate receiving a constant low voltage VGL, a source electrically connected to a drain of the second TFT M2, and a drain electrically connected to a first node PD(n) of the n-th GOA unit;

the second TFT M2 has a gate and a source, both receiving the scan signal SCAN(n−1) of the (n−1)-th GOA unit;

the third TFT M3 has a gate receiving the constant low voltage VGL, a source electrically connected to the scan signal SCAN(n−1) of the (n−1)-th GOA unit, and a drain electrically connected to a gate of the fifth TFT M5;

the fourth TFT M4 has a gate receiving the constant low voltage VGL, a source electrically connected to the first node PD(n) of the n-th GOA unit, and a drain electrically connected to a source of the sixth TFT M6;

the fifth TFT M5 has a source electrically connected to a second node PU(n) of the n-th GOA unit, and a drain receiving a constant high voltage VGH;

the sixth TFT M6 has a gate electrically connected to the second node PU(n) of the n-th GOA unit, and a drain receiving a constant high voltage VGH;

the seventh TFT M7 has a gate electrically connected to the drain of the third TFT M3, a source electrically connected to a drain of the eighth TFT M8, and a drain receiving the constant high voltage VGH;

the eighth TFT M8 has a gate and a source, both receiving the m-th clock signal CK(m);

the ninth TFT M9 has a gate receiving the (m+1)-th clock signal CK(m+1), a source electrically connected to a drain of the tenth TFT M10, and a drain electrically connected to the second node PU(n) of the n-th GOA unit;

the tenth TFT M10 a gate electrically connected to the drain of the eighth TFT M8, and a source receiving the (m+1)-th clock signal CK(m+1);

the eleventh TFT M11 has a gate electrically connected to the second node PU(n) of the GOA unit, a source electrically connected to a drain of the twelfth TFT M12, and a drain receiving the constant high voltage VGH;

the twelfth TFT M12 has a gate electrically connected to the first node PD(n) of the GOA unit, a source receiving the m-th clock signal CK(m), and a drain outputting the scan signal SCAN(n) of the n-th GOA unit;

the first capacitor C1 has a first end electrically connected to the source of the sixth TFT M6, and a second end receiving the constant high voltage VGH;

the second capacitor C2 has a first end electrically connected to the first node PD(n) of the GOA unit, and a second end electrically connected to the drain of the twelfth TFT M12;

the third capacitor C3 has a first end electrically connected to the second node PU(n) of the GOA unit, and a second end receiving the constant high voltage VGH;

the fourth capacitor C4 has a first end electrically connected to the drain of the eighth TFT M8, and a second end receiving the constant high voltage VGH.

Specifically, the emitting signal output module 200 comprises: a thirteenth TFT M13, a fourteenth TFT M14, a fifteenth TFT M15, a sixteenth TFT M16, and a fifth capacitor C5.

Wherein the thirteenth TFT M13 has a gate receiving the scan signal SCAN(n) of the n-th GOA unit, a source receiving the constant high voltage VGH, and a drain electrically connected to a source of the fourteenth TFT M14;

the fourteenth TFT M14 has a gate receiving the emitting signal EM(n) of the n-th GOA unit, and a drain receiving the constant low voltage VGL;

the fifteenth TFT M15 has a gate receiving the emitting signal EM(n) of the n-th GOA unit, a source receiving the constant high voltage VGH, and a drain outputting the emitting signal EM(n) of the n-th GOA unit;

the sixteenth TFT M16 has a gate electrically connected to the drain of the thirteen TFT M13, a source electrically connected to the drain of the fifteenth TFT M15, and a drain receiving the constant low voltage VGL;

the fifth capacitor C5 has a first end electrically connected to the drain of the thirteenth TFT M13, and a second end receiving the m-th clock signal CK(m).

Specifically, the first TFT M1, the second TFT M2, the third TFT M3, the fourth TFT M4, the fifth TFT M5, the sixth TFT M6, the seventh TFT M7, the eighth TFT M8, the ninth TFT M9, the tenth TFT M10, the eleventh TFT M11, the twelfth TFT M12, the thirteenth TFT M13, the fourteenth TFT M14, the fifteenth TFT M15, and the sixteenth TFT M16 are all P-type TFTs.

Specifically, the GOA circuit comprises two clock signals; a first clock signal CK(1) and a second clock signal CK(2); and the clock signal CK(1) and the second clock signal CK(2) have opposite phases. When the m-th clock signal CK(m) is the first clock signal CK(1), the (m+1)-th clock signal CK(m+1) is the second clock signal CK(2); when the m-th clock signal CK(m) is the second clock signal CK(2), the (m+1)-th clock signal CK(m+1) is the first clock signal CK(1).

Furthermore, in two adjacent GOA units, for one GOA unit, the gate of the eighth TFT M8 is connected to the first clock signal CK(1), the source of the tenth TFT M10 is connected to the second clock signal CK(2); and for the other GOA unit, the gate of the eighth TFT M8 of the cell is connected to the second clock signal CK(2), and the source of the tenth TFT M10 is connected to the first clock signal CK(1). For example, when the gate of the eighth TFT M8 of the first GOA unit is connected to the first clock signal CK(1) and the source of the tenth TFT M10 is connected to the second clock signal CK(2), the gate of the eighth TFT M8 of the second GOA unit is connected to the second clock signal CK(2), and the source of the tenth TFT M10 of the second GOA unit is connected to the first clock signal CK(1).

Figure 2:
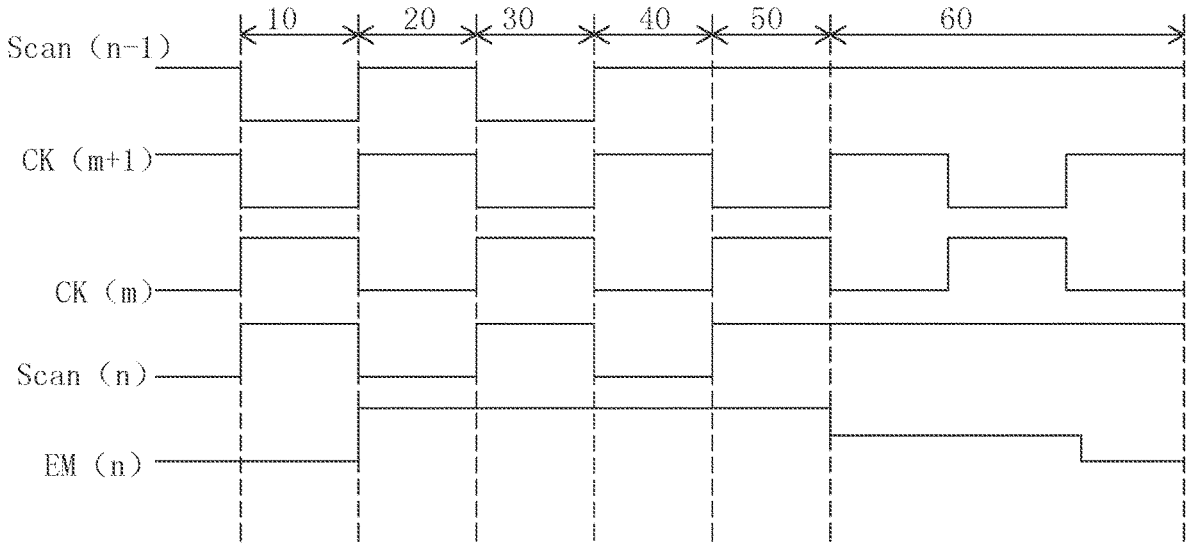
FIG. 2 is a schematic view showing a timing sequence of the GOA circuit provided by the embodiment of the present invention.

Specifically, referring to FIG. 2, take the n-th GOA unit as an example, the operation of the GOA circuit is as follows:

The first phase 10: the scan signal SCAN(n−1) of the (n−1)-th GOA unit is at a low voltage level, the (m+1)-th clock signal CK(m+1) is at a low voltage level, the m-th clock signal CK (m) is at a high voltage level, the first TFT M1, the second TFT M2, the third TFT M3, the fourth TFT M4 and the ninth TFT M9 are all turned on, the eighth TFT M8 is turned off, the low voltage of the scan signal SCAN (n−1) of the (n−1)-th GOA unit is written into the first node PD(n) of the n-th GOA unit so that the twelfth TFT M12 is turned on; the m-th clock signal CK(m) is high, the scan signal SCAN(n) of the n-th GOA unit is at a high voltage level, the thirteenth TFT M13 and the fifteenth TFT M15 are turned off and the emitting signal EM is at a low voltage level during the previous frame period so that the fourteenth TFT M14 and the sixteenth TFT M16 are turned on and the emitting signal EM is maintained at a low voltage level while the low voltage of the scan signal SCAN(n−1) of the (n−1)-th GOA unit is also written into the gate of the fifth TFT M5 and the gate of the seventh TFT M7 so that the fifth TFT M5 and the seventh TFT M7 are turned on, the voltage level of the second node PU(n) of the n-th GOA unit is equal to the constant high voltage VGH, the sixth TFT M6 and the eleventh TFT M11 are turned off.

The second phase 20: the scan signal SCAN(n−1) of the (n−1)-th GOA unit is at a high voltage level, the (m+1)-th clock signal CK(m+1) is at a high voltage level, the m-th clock signal CK (m) is at a low voltage level, the first TFT M1, the third TFT M3, the fourth TFT M4 and eighth TFT M8 are all turned on, the second TFT M2 and the ninth TFT M9 are turned off, the first node PD(n) of the n-th GOA unit is maintained at low voltage level, the twelfth TFT M12 stays turned on; the math clock signal CK(m) is low, the scan signal SCAN(n) of the n-th GOA unit is at a low voltage level, coupled by the second capacitor C2, the first node PD(n) of the n-th GOA unit continues to be pulled down to keep the twelfth TFT M12 staying turned on, outputting a low scan signal SCAN(n) of the n-th GOA unit, the thirteenth TFT M13 and the fifteenth TFT M15 are turned on and the emitting signal EM becomes at the level of the constant high voltage VGH, the fourteenth TFT M14 and the sixteenth TFT M16 are turned off while the second node PU(n) of the n-th GOA unit is maintained at the constant high voltage VGH, the sixth TFT M6 and the eleventh TFT M11 are turned off.

The third phase 30: the scan signal SCAN(n−1) of the (n−1)-th GOA unit is at a low voltage level, the (m+1)-th clock signal CK(m+1) is at a low voltage level, the m-th clock signal CK (m) is at a high voltage level, the first TFT M1, the second TFT M2, the third TFT M3, the fourth TFT M4 and the ninth TFT M9 are all turned on, the eighth TFT M8 is turned off, he first node PD(n) of the n-th GOA unit is maintained at low voltage level, the twelfth TFT stays turned on; the m-th clock signal CK(m) is low, the scan signal SCAN(n) of the n-th GOA unit is at a high voltage level, the thirteenth TFT M13 and the fifteenth TFT M15 are turned off, and because the emitting signal EM is at a high voltage level during the previous phase, the fourteenth TFT M14 and the sixteenth TFT M16 are turned off and the emitting signal EM is maintained at a high voltage level while the second node PU(n) of the n-th GOA unit is maintained at the constant high voltage VGH, the sixth TFT M6 and the eleventh TFT M11 are turned off.

The fourth phase 40: the scan signal SCAN(n−1) of the (n−1)-th GOA unit is at a high voltage level, the (m+1)-th clock signal CK(m+1) is at a high voltage level, the m-th clock signal CK (m) is at a low voltage level, the first TFT M1, the third TFT M3, the fourth TFT M4 and eighth TFT M8 are all turned on, the second TFT M2 and the ninth TFT M9 are turned off, the first node PD(n) of the n-th GOA unit is maintained at low voltage level, the twelfth TFT M12 stays turned on; the m-th clock signal CK(m) is low, the scan signal SCAN(n) of the n-th GOA unit is at a low voltage level, coupled by the second capacitor C2, the first node PD(n) of the n-th GOA unit continues to be pulled down and the low scan signal SCAN(n) of the n-th GOA continue to output, the thirteenth TFT M13 and the fifteenth TFT M15 are turned on and because the emitting signal EM is high during the previous phase, the fourteenth TFT M14 and the sixteenth TFT M16 continue to be turned off and the emitting signal EM stays at the constant high voltage VGH.

The fifth phase 50: the scan signal SCAN(n−1) of the (n−1)-th GOA unit is at a high voltage level, the (m+1)-th clock signal CK(m+1) is at a low voltage level, the m-th clock signal CK (m) is at a high voltage level, the first TFT M1, the third TFT M3, the fourth TFT M4, the ninth TFT M9, and the tenth TFT M10 are all turned on, the fifth TFT M5 and the seventh TFT M7 are turned off, the second node PU(n) of the n-th GOA unit becomes at a low voltage level, the sixth TFT M6 and the eleventh TFT M11 are turned on; the first node PD(n) of the n-th GOA unit rises to a high voltage level and the twelfth TFT M12 is turned on, the scan signal SCAN(n) of the n-th GOA becomes high, the thirteenth TFT M13 and the fifteenth TFT M15 are turned off and because the emitting signal EM is high during the previous phase, the fourteenth TFT M14 and the sixteenth TFT M16 continue to be turned off and the emitting signal EM stays at the constant high voltage VGH.

The sixth phase 60: the scan signal SCAN(n−1) of the (n−1)-th GOA unit is at a high voltage level, the first node PD(n) of the n-th GOA unit is maintained at a high voltage level, the second node PU(n) of the n-th GOA unit is maintained at a low voltage level, the scan signal SCAN(n) of the n-th GOA is maintained at a high voltage level, the aforementioned opposite-phased clock signals switch high/low voltage levels, through the coupling effect, the voltage level at the gates of the fourteenth TFT M14 and the sixteenth TFT M16 is gradually lowered and the emitting signal EM finally becomes at a low voltage level.

Figure 3:
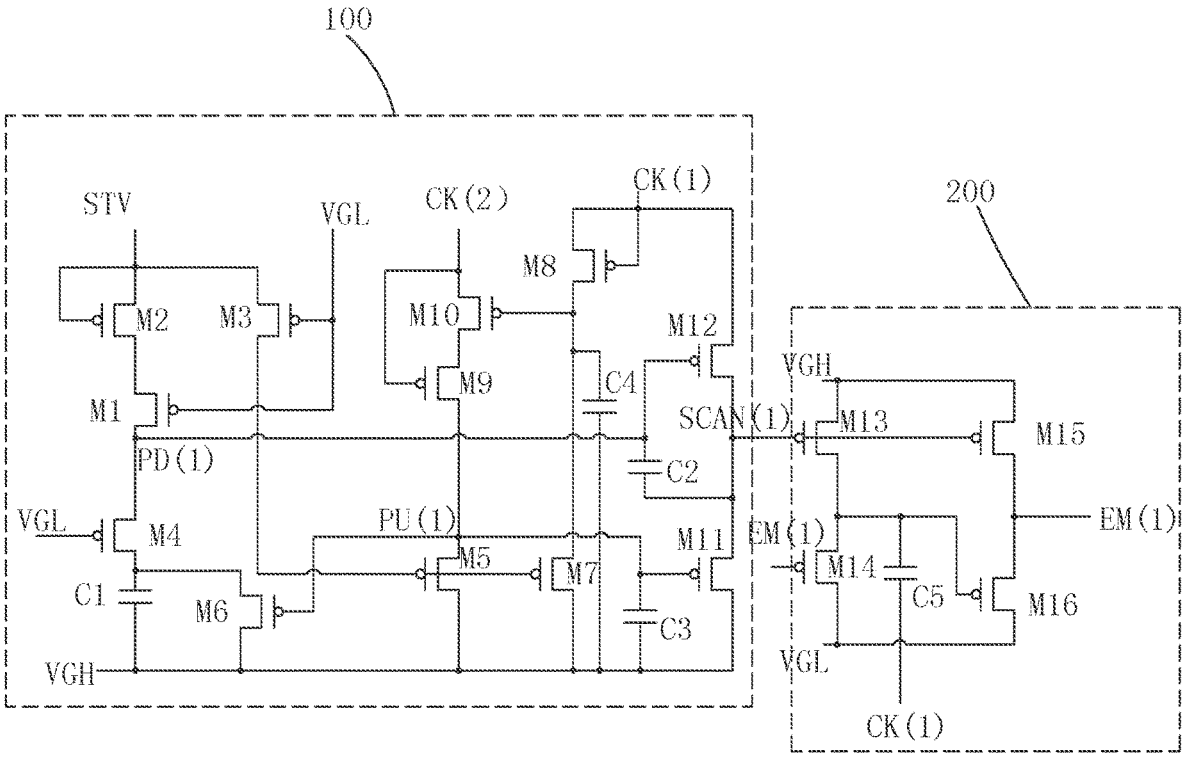
FIG. 3 is a schematic view showing the first GOA unit of the GOA circuit provided by the embodiment of the present invention.

Refer to FIG. 3. It should be noted that, because the first GOA unit has no other GOA units provide the scan signal. Therefore, in order to enable the first GOA unit to start working normally, a circuit start signal STV is provided so that, in the first GOA unit, the gate and the source of the second TFT M2 are both connected to the circuit start signal STV. During a frame period, the waveform of the circuit start signal STV is low in both the first phase 10 and the third phase 30, and high in the fourth to sixth phases 40, 50, and 60, while the voltage level in the second phase 20 is not limited, and may be selected as a low or a high voltage level without affecting the normal implementation of the present invention. Preferably, in the second phase 20, the circuit starts Signal STV is low. The scanning of one frame of image is started by inputting the circuit start signal STV to the GOA circuit.

Based on the aforementioned GOA circuit, the present invention also provides an OLED display device, which comprises the above GOA circuit. Preferably, the OLED display device is a flexible OLED display device.

In summary, the present invention provides a GOA circuit, comprising a plurality of cascaded GOA units, with each GOA unit comprising: a scan signal output module and an emitting signal output module electrically connected to the scan signal output module; during a frame period, the scan signal output module is capable of outputting a scanning signal including at least two low potential pulses within a frame time, and the light emitting signal output module can output a valid emitting signal according to the scan signal outputted by the scan signal output module. Thus, the GOA circuit for scan signal and the GOA circuit for emitting signal in the conventional design are integrated into a GOA circuit, which can reduce the number of TFTs and capacitors, simplify the circuit structure, and facilitate narrow-border display. The present invention also provides an OLED display device, with a GOA circuit capable of outputting a scan signal and an emitting signal at the same time, and the circuit structure is simple and is conducive to the realization of a narrow-border display.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A gate driver on array (GOA) circuit, which comprises: a plurality of cascaded GOA devices, with each GOA device comprising: a scan signal output device and an emitting signal output device electrically connected to the scan signal output device;

for a positive integer n, except the first GOA device, in the n-th GOA device:

the scan signal output device, receiving an m-th clock signal, an (m+1)-th clock signal, and a scan signal of the (n−1)-th GOA device, for outputting a scan signal of n-th GOA device to sub-pixels of n-th row and the emitting signal output device of the n-th GOA device according to the m-th clock signal under the control of the scan signal of the (n−1)-th GOA device;

the emitting signal output device, receiving the scan signal outputted by the scan signal output device of the n-th GOA device, for outputting an emitting signal of the n-th GOA device to the sub-pixels of n-th row;

during a frame period, the scan signal of each GOA device comprising at least two low voltage pulses, the emitting signal of each GOA device having a duration of outputting high voltage longer than twice the pulse cycle of the m-th clock signal, and the m-th clock signal and the (m+1)-th clock signal having opposite phases;

wherein the scan signal output device comprises: a first thin film transistor (TFT), a second TFT, a third TFT, a fourth TFT, a fifth TFT, a sixth TFT, a seventh TFT, an eighth TFT, a ninth TFT, a tenth TFT, an eleventh TFT, a twelfth TFT, a first capacitor, a second capacitor, a third capacitor, and a fourth capacitor;

the first TFT having a gate receiving a constant low voltage, a source electrically connected to a drain of the second TFT, and a drain electrically connected to a first node of the n-th GOA device;

the second TFT having a gate and a source, both receiving the scan signal of the (n−1)-th GOA device;

the third TFT having a gate receiving the constant low voltage, a source electrically connected to the source of the second TFT, and a drain electrically connected to a gate of the fifth TFT;

the fourth TFT having a gate receiving the constant low voltage, a source electrically connected to the first node of the n-th GOA device, and a drain electrically connected to a source of the sixth TFT;

the fifth TFT having a source electrically connected to a second node of the n-th GOA device, and a drain receiving a constant high voltage;

the sixth TFT having a gate electrically connected to the second node of the n-th GOA device, and a drain receiving a constant high voltage;

the seventh TFT having a gate electrically connected to the drain of the third TFT, a source electrically connected to a drain of the eighth TFT, and a drain receiving the constant high voltage;

the eighth TFT having a gate and a source, both receiving the m-th clock signal;

the ninth TFT having a gate receiving the (m+1)-th clock signal, a source electrically connected to a drain of the tenth TFT, and a drain electrically connected to the second node of the n-th GOA device;

the tenth TFT having a gate electrically connected to the drain of the eighth TFT, and a source receiving the (m+1)-th clock signal;

the eleventh TFT having a gate electrically connected to the second node of the GOA device, a source electrically connected to a drain of the twelfth TFT, and a drain receiving the constant high voltage;

the twelfth TFT having a gate electrically connected to the first node of the GOA device, a source receiving the m-th clock signal, and a drain outputting the scan signal of the n-th GOA device;

the first capacitor having a first end electrically connected to the source of the sixth TFT, and a second end receiving the constant high voltage;

the second capacitor having a first end electrically connected to the first node of the GOA device, and a second end electrically connected to the drain of the twelfth TFT;

the third capacitor having a first end electrically connected to the second node of the GOA device, and a second end receiving the constant high voltage;

the fourth capacitor having a first end electrically connected to the drain of the eighth TFT, and a second end receiving the constant high voltage.

2. The GOA circuit as claimed in claim 1, wherein the emitting signal output device comprises: a thirteenth TFT, a fourteenth TFT, a fifteenth TFT, a sixteenth TFT, and a fifth capacitor;

the thirteenth TFT having a gate receiving the scan signal of the n-th GOA device, a source receiving the constant high voltage, and a drain electrically connected to a source of the fourteenth TFT;

the fourteenth TFT having a gate receiving the emitting signal of the n-th GOA device, and a drain receiving the constant low voltage;

the fifteenth TFT having a gate receiving the emitting signal of the n-th GOA device, a source receiving the constant high voltage, and a drain outputting the emitting signal of the n-th GOA device;

the sixteenth TFT having a gate electrically connected to the drain of the thirteen TFT, a source electrically connected to the drain of the fifteenth TFT, and a drain receiving the constant low voltage;

the fifth capacitor having a first end electrically connected to the drain of the thirteenth TFT, and a second end receiving the m-th clock signal.

3. The GOA circuit as claimed in claim 2, wherein the thirteenth TFT, the fourteenth TFT, the fifteenth TFT, and the sixteenth TFT are all P-type TFTs.

4. The GOA circuit as claimed in claim 1, wherein the GOA circuit comprises two clock signals; a first clock signal and a second clock signal; when the m-th clock signal is the second clock signal, the (m+1)-th clock signal is the first clock signal.

5. The GOA circuit as claimed in claim 1, wherein in the first GOA device, both the gate and the source of the second TFT receive a circuit start signal.

6. The GOA circuit as claimed in claim 1, wherein the first TFT, the second TFT, the third TFT, the fourth TFT, the fifth TFT, the sixth TFT, the seventh TFT, the eighth TFT, the ninth TFT, the tenth TFT, the eleventh TFT, and the twelfth TFT are all P-type TFTs.

7. An organic light-emitting diode (OLED) display device, comprising the GOA circuit as claimed in claim 1.

8. The OLED display device as claimed in claim 7, wherein the OLED display device is a flexible OLED display device.

9. A gate driver on array (GOA) circuit, which comprises: a plurality of cascaded GOA devices, with each GOA device comprising: a scan signal output device and an emitting signal output device electrically connected to the scan signal output device;

for a positive integer n, except the first GOA device, in the n-th GOA device:

the scan signal output device, receiving an m-th clock signal, an (m+1)-th clock signal, and a scan signal of the (n−1)-th GOA device, for outputting a scan signal of n-th GOA device to sub-pixels of n-th row and the emitting signal output device of the n-th GOA device according to the m-th clock signal under the control of the scan signal of the (n−1)-th GOA device;

the emitting signal output device, receiving the scan signal outputted by the scan signal output device of the n-th GOA device, for outputting an emitting signal of the n-th GOA device to the sub-pixels of n-th row;

during a frame period, the scan signal of each GOA device comprising at least two low voltage pulses, the emitting signal of each GOA device having a duration of outputting high voltage longer than twice the pulse cycle of the m-th clock signal, and the m-th clock signal and the (m+1)-th clock signal having opposite phases;

wherein the scan signal output device comprising: a first thin film transistor (TFT), a second TFT, a third TFT, a fourth TFT, a fifth TFT, a sixth TFT, a seventh TFT, an eighth TFT, a ninth TFT, a tenth TFT, an eleventh TFT, a twelfth TFT, a first capacitor, a second capacitor, a third capacitor, and a fourth capacitor;

the first TFT having a gate receiving a constant low voltage, a source electrically connected to a drain of the second TFT, and a drain electrically connected to a first node of the n-th GOA unit device;

the second TFT having a gate and a source, both receiving the scan signal of the (n−1)-th GOA device;

the third TFT having a gate receiving the constant low voltage, a source electrically connected to the source of the second TFT, and a drain electrically connected to a gate of the fifth TFT;

the fourth TFT having a gate receiving the constant low voltage, a source electrically connected to the first node of the n-th GOA device, and a drain electrically connected to a source of the sixth TFT;

the fifth TFT having a source electrically connected to a second node of the n-th GOA device, and a drain receiving a constant high voltage;

the sixth TFT having a gate electrically connected to the second node of the n-th GOA device, and a drain receiving a constant high voltage;

the seventh TFT having a gate electrically connected to the drain of the third TFT, a source electrically connected to a drain of the eighth TFT, and a drain receiving the constant high voltage;

the eighth TFT having a gate and a source, both receiving the m-th clock signal;

the ninth TFT having a gate receiving the (m+1)-th clock signal, a source electrically connected to a drain of the tenth TFT, and a drain electrically connected to the second node of the n-th GOA device;

the tenth TFT having a gate electrically connected to the drain of the eighth TFT, and a source receiving the (m+1)-th clock signal;

the eleventh TFT having a gate electrically connected to the second node of the GOA device, a source electrically connected to a drain of the twelfth TFT, and a drain receiving the constant high voltage;

the twelfth TFT having a gate electrically connected to the first node of the GOA device, a source receiving the m-th clock signal, and a drain outputting the scan signal of the n-th GOA device;

the first capacitor having a first end electrically connected to the source of the sixth TFT, and a second end receiving the constant high voltage;

the second capacitor having a first end electrically connected to the first node of the GOA device, and a second end electrically connected to the drain of the twelfth TFT;

the third capacitor having a first end electrically connected to the second node of the GOA device, and a second end receiving the constant high voltage;

the fourth capacitor having a first end electrically connected to the drain of the eighth TFT, and a second end receiving the constant high voltage;

wherein the emitting signal output device comprising: a thirteenth TFT, a fourteenth TFT, a fifteenth TFT, a sixteenth TFT, and a fifth capacitor;

the thirteenth TFT having a gate receiving the scan signal of the n-th GOA device, a source receiving the constant high voltage, and a drain electrically connected to a source of the fourteenth TFT;

the fourteenth TFT having a gate receiving the emitting signal of the n-th GOA device, and a drain receiving the constant low voltage;

the fifteenth TFT having a gate receiving the emitting signal of the n-th GOA device, a source receiving the constant high voltage, and a drain outputting the emitting signal of the n-th GOA device;

the sixteenth TFT having a gate electrically connected to the drain of the thirteen TFT, a source electrically connected to the drain of the fifteenth TFT, and a drain receiving the constant low voltage;

the fifth capacitor having a first end electrically connected to the drain of the thirteenth TFT, and a second end receiving the m-th clock signal;

comprising two clock signals; a first clock signal and a second clock signal; when the m-th clock signal being the second clock signal, the (m+1)-th clock signal being the first clock signal;

wherein in the first GOA device, both the gate and the source of the second TFT receiving a circuit start signal.

10. The GOA circuit as claimed in claim 9, wherein the first TFT, the second TFT, the third TFT, the fourth TFT, the fifth TFT, the sixth TFT, the seventh TFT, the eighth TFT, the ninth TFT, the tenth TFT, the eleventh TFT, and the twelfth TFT are all P-type TFTs.

11. The GOA circuit as claimed in claim 9, wherein the thirteenth TFT, the fourteenth TFT, the fifteenth TFT, and the sixteenth TFT are all P-type TFTs.

* * * * *